United States Patent [19]

Seaver et al.

[11] Patent Number: 4,748,043

[45] Date of Patent: May 31, 1988

[54] ELECTROSPRAY COATING PROCESS

[75] Inventors: Albert E. Seaver; Carey J. Eckhardt, both of St. Paul, Minn.

[73] Assignee: Minnesota Mining and Manufacturing Company, Saint Paul, Minn.

[21] Appl. No.: 902,218

[22] Filed: Aug. 29, 1986

[51] Int. Cl.[4] ..... B05D 1/04; B05B 5/02

[52] U.S. Cl. ..... 427/30; 427/32; 427/39; 118/638; 118/630; 118/72; 346/140 R; 239/696

[58] Field of Search ..... 427/30, 32, 39; 118/629, 630, 638, 72; 239/696, 695, 706, 708; 346/140 PD

[56] References Cited

U.S. PATENT DOCUMENTS

| | | | |
|---|---|---|---|
| 1,958,406 | 5/1934 | Darrah | 299/1 |
| 2,893,894 | 7/1959 | Ransburg | 117/93 |
| 3,052,213 | 9/1962 | Schaffert | 118/647 |
| 3,060,429 | 10/1962 | Winston | 346/75 |
| 3,157,819 | 11/1964 | Krohn, Jr. | 315/111 |
| 3,503,704 | 3/1970 | Marks | 23/2 |
| 3,596,275 | 7/1971 | Sweet | 346/1 |
| 3,717,722 | 2/1973 | Messner | 118/630 |
| 3,776,187 | 12/1973 | Probst | 118/626 |
| 3,810,874 | 5/1974 | Mitsch et al. | 260/75 |
| 3,911,448 | 10/1975 | Ohno et al. | 346/140 PD |
| 4,209,696 | 6/1980 | Fite | 250/281 |
| 4,264,641 | 4/1981 | Mahoney et al. | 427/304 |
| 4,333,086 | 6/1982 | Ebi | 346/140 PD |
| 4,356,528 | 10/1982 | Coffee | 361/226 |
| 4,381,342 | 4/1983 | Heyningen | 430/496 |
| 4,404,573 | 9/1983 | Kocot et al. | 346/140 PD |
| 4,476,515 | 10/1984 | Coffee | 361/226 |

OTHER PUBLICATIONS

Publication–Physical Review, Zeleny, vol. 3, p. 69 (1914).
Journal of Colloid Science, vol. 7, p. 616 (1952).
Journal of Colloid Science, vol. 13, p. 179 (1958).
AIAA Journal, vol. 6, p. 496 (1968).
Journal of Applied Physics, vol. 5, p. 3174 (1979).
Handbook of Analytical Derivatization Reactions–Knapp, p. 166.

*Primary Examiner*—John E. Kittle
*Assistant Examiner*—Alain Bashore
*Attorney, Agent, or Firm*—Donald M. Sell; James A. Smith; John C. Barnes

[57] ABSTRACT

An electrostatic coating system for applying very thin coating to a substrate in air at atmospheric pressure comprises a plurality of spaced capillary needles positioned in at least two rows and fed with coating liquid via a manifold. The needles are disposed concentric within holes in an extractor plate, a potential is developed between the capillary needles and the extractor plate affording a reduction of the liquid to a mist of highly charged droplets drawn to the substrate by a second electrical field. Insulative layers on the extractor plate provide increased droplet control.

17 Claims, 3 Drawing Sheets

ELECTROSPRAY COATING PROCESS

BACKGROUND OF THE INVENTION

1. Field of the Invention

This invention relates to a device for coating a continuous substrate and in one aspect to an apparatus and method for electrospraying a coating material onto a substrate.

2. Description of the Prior Art

A number of substrate coating methods are presently available. Mechanical applications such as roll coating, knife coating and the like are easy and inexpensive in themselves. However, because these methods give thick coatings of typically greater than 5 micrometers (um), there are solvent to be disposed of and this disposal requires large drying ovens and pollution control equipment, thus making the total process expensive and time consuming. These processes are even more awkward for applying very thin coatings, for example, less than 500 Angstroms (Å). To apply such thin coatings by present coating techniques requires very dilute solutions and therefore very large amounts of solvent must be dried off. The uniformity and thickness of the dried final coating is difficult to control.

Physical vapor deposition techniques are useful for applying thin and very thin coatings on substrates. They require high vacuums with the attendant processing problems for a continuous process and are therefore capital intensive. They also can only coat materials that can be sputtered or vapor coated.

The present invention relates to an electrostatic spraying process but it is unlike conventional electrostatic processes which have been used for a number of years. Such processes for example, are used in the painting industry and textile industry where large amounts of material are applied to flat surfaces wherein application of such coatings use a droplet size in the 100 micrometer range with a large distribution of drop sizes. Uniform coatings thus start at about 200 micrometer thickness, which are thick film coating processes. Significant amounts of solvents are required and these solvents do not evaporate in travel from sprayer to substrate so the coating is a solvent wet coating which then requires drying. It is difficult to coat nonconductive substrates with these processes. The spray head design for these electrostatic coating processes usually are noncapillary and designed so that the charged material to be coated comes off a sharp edge or point and forms very large droplets. For example, Ransburg, U.S. Pat. No. 2,893,894 shows an apparatus for coating paints and the like from an electrostatic spray gun. Probst, U.S. Pat. No. 3,776,187 teaches electrostatic spraying of carpet backings from a knife edge type apparatus.

Liquid jet generators for ink jet printing are a controlled form of electrostatic spraying. In ink jet generators, streams of drops of liquid on the order of 75 to 125 micrometers in diameter are produced, charged and then guided in single file by electric fields along the drop stream path to the desired destination to form the printed character. Sweet, U.S. Pat. No. 3,596,275 describes such a generator wherein the series of drops are produced by spaced varicosities in the issuing jet by either mechanical or electrical means. These drops are charged and passed one by one through a pair of electrostatic deflecting electrodes thereby causing the writing to occur on a moving substrate beneath the generator.

Van Heyningen, U.S. Pat. No. 4,381,342 discloses a method for depositing photographic dyes on film substrates using three such ink jet generators as just described in tandem and causing each different material to be laid down in a controlled non-overlapping matrix.

The design of structures to generate small charged droplets are different from the aforementioned devices for painting and jet printing. Zelany, Physical Review, Vol. 3, p. 69 (1914) used a charged capillary to study the electrical charges on droplets. Darrah, U.S. Pat. No. 1,958,406, sprayed small charged droplets into ducts and vessels as reactants because he found such droplets to be "in good condition for rapid chemical action".

In an article in Journal of Colloid Science, Vol. 7, p. 616 Vonnegut & Neubauer (1952) there is a teaching of getting drops below 1 micrometer in diameter by using a charged fluid. Newab and Mason, Journal of Colloid Science, Vol. 13, p. 179, (1958) used a charged metal capillary to produce fine drops and collected them in a liquid. Krohn, U.S. Pat. No. 3,157,819, showed an apparatus for producing charged liquid particles for space vehicles. Pfeifer and Hendricks, AIAA Journal, Vol. 6, p. 496, (1968) studied Krohn's work and used a charged metal capillary and an extractor plate (ground return electrode) to expel fine droplets away from the capillary to obtain a fundamental understanding of the process. Marks, U.S. Pat. No. 3,503,704 describes such a generator to impart charged particles in a gas stream to control and remove pollutants. Mutoh, et al, Journal of Applied Physics, Vol. 50, p. 3174 (1979) described the disintegration of liquid jets induced by an electrostatic field. Fite, U.S. Pat. No. 4,209,696, describes a generator to create molecules and ions for further analysis and to produce droplets containing only one molecule or ion for use in a mass spectrometer and also describes the known literature and the concept of the electrospray method as practiced since Zeleny's studies. Mahoney, U.S. Pat. No. 4,264,641, claimed a method to produce molten metal powder thin films in a vacuum using electrohydrodynamic spraying. Coffee, U.S. Pat. No. 4,356,528 and U.S. Pat. No. 4,476,515 describes a process and apparatus for spraying pesticides on field crops and indicates the ideal drop size for this application is between 30 and 200 micrometers.

The prior art does not teach an electrostatic coater for applying a coatings 10 to 5000 Å. thick at atmospheric pressure.

The prior art does not teach the use of a coater with a wide electrostatic spray head having a plurality of capillary needles.

SUMMARY OF THE INVENTION

The present invention provides a noncontacting method and a multi-orifice spray apparatus to accurately and uniformly apply a coating onto a substrate to any desired coating thickness from a few tens of angstroms to a few thousand angstroms at atmospheric pressure and at industrially acceptable process coating speeds. The process is most useful in coating webs, disks, and other flat surfaces although irregular substrates can also be coated.

The electrospray coating head comprises a plurality of capillary needles communicating with a fluid manifold and arranged in two or more staggered rows transverse to the path of the web to be coated. A conductive extractor plate has a plurality of holes positioned to receive the needles coaxially in the holes. The extractor plate and needles are connected to a high voltage electrical source with the plate and needles at opposite polarity to define a potential between the two. A second potential is developed between the needles and the receptor web.

The coating process of the present invention is useful in coating monomers, oligomers and solutions onto a substrate in a uniform coating at a thickness of 10 to 5000 Angstroms at atmospheric pressure in air. The process comprises cleaning a web if necessary, charging the web, advancing the web transversely of at least two rows of capillary needles extending through an extractor plate, pumping the coating material through the needles, developing a high voltage electric field between the needles and the extractor plate to spray the web, and removing the excess charge on the web. A curing step may be necessary, depending on the material. The web can receive a second coating or be rewound.

BRIEF DESCRIPTION OF THE DRAWINGS

The invention will be described in greater detail with reference to the accompanying drawings wherein.

DESCRIPTION OF THE PREFERRED EMBODIMENTS

The present invention relates to an electrospray process for applying thin and very thin coatings to substrates. As used herein electrospray, also referred to as electrohydrodynamic spray, if a type of electrostatic spray. While electrostatic spray is the use of electric fields to create and act on charged droplets of the material to be coated so as to control said material application, it is normally practiced by applying heavy coatings of material as for example in paint spraying of parts. In the present invention electrospray describes the spraying of very fine droplets from a plurality of spaced capillary needles and directing these droplets by action of a field onto substrates, usually in very thin coating thicknesses.

Thin films and very thin films of selected materials on substrates are useful as primers, low adhesion backsizes, release coatings, lubricants and the like. In many cases only a few monomolecular layers of material are required and the present invention is capable of appying such coatings at thicknesses of a few angstroms to a few thousand angstroms. The concept of this invention is the generation of an ultra-fine mist of material and the controlled application of that mist to a substrate to provide a uniform thin film coating of the material on the substrate.

Figure 1:
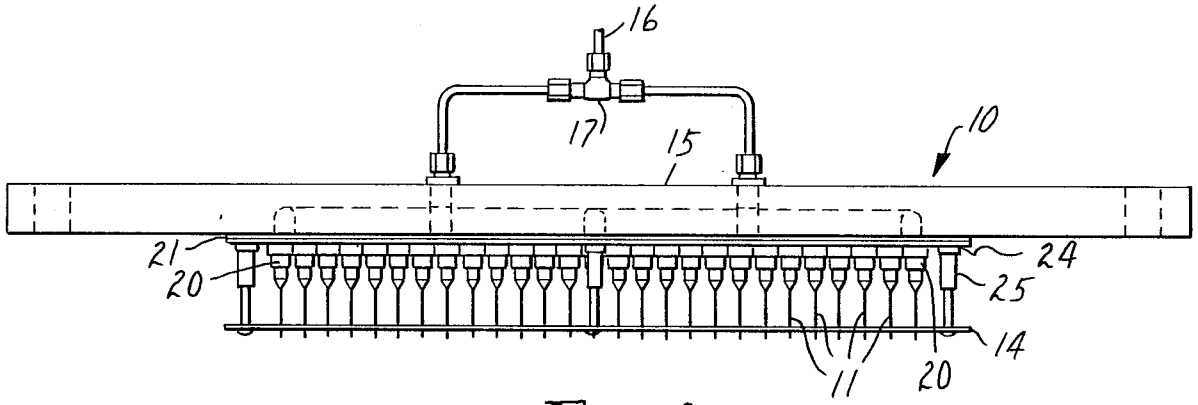
FIG. 1 is a front elevational view showing one embodiment of the dispensing and coating head of this invention.
Figure 2:
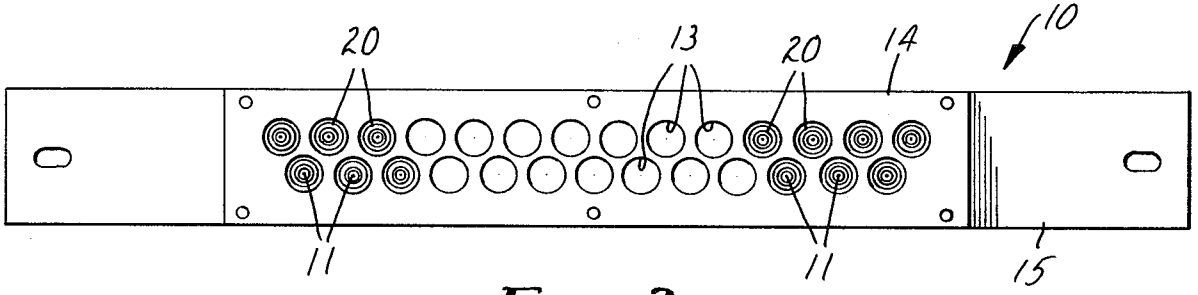
FIG. 2 is a bottom view of the dispensing and coating head.

The coating head, generally designated 10, comprises a plurality of capillary tubes or needles 11 in two parallel rows to produce an even, uniform coating of material on a substrate moved beneath the head 10. A coating head design utilizing 27 such needles to produce a 30.5 cm wide coating on a substrate is shown in FIG. 1. The capillary needles 11 have a very small bore of a size in which capillarity takes place but the needles must be large enough in inside diameter so that plugging does not occur for normally clean fluids. The extractor plate holes 13 are large enough to assure arcing does not occur between the plate 14 and the needles 11 but small enough to provide the desired electric field strength necessary to generate the mist of droplets.

The liquid to be electrosprayed is fed into an electrospray manifold 15 from a feeder line 16 which is also attached to a suitable liquid pump (not shown). The line 16 is connected to a tee 17 to direct liquid toward both sides of the manifold 15, and the liquid in manifold 15 is distributed to the array of capillary needles 11. Stainless steel needles with an inside diameter (ID) of 300 micrometers (um) and an outside diameter (OD) of 500 um and length of 2.5 centimeters (cm) have been used. The needles 11 are covered with size 24 Voltex Tubing, an insulative tubing from SPC Technology, Chicago, Ill., to within 0.8 mm of their tip to restrict buildup of coating material on the needles. The needles 11 have a seat 20 attached to a metal plate 21. The plate 21 is connected to a high voltage supply $V_1$ through a wire 24. The extractor plate 14 is formed of aluminum or stainless steel and is insulated from the high voltage plate 21 using ceramic adjustable spacers 25 which position the needles through the holes of the extractor plate 14 with the tips of the capillary needles 11 extending slightly beyond the extractor plate. The bottom planar surface and planar edges of the extractor plate 14 is covered with a 0.2 mm thickness of Scotch® Brand 5481 insulative film pressure sensitive adhesive tape available from Minnesota Mining and Manufacturing Company of St. Paul, Minn. The tape is an insulator and prevents buildup of electrospray material on this surface. Alternatively, the bottom of this plate can be covered with other insulating material. The extractor plate 14 is 1.6 mm thick and has 27 1.9 cm ID holes 13 drilled in it and placed 2.2 cm on center. These holes 13 are aligned with one hole concentric with each capillary needle 11. As a result, an electric field $E_1$ (see FIG. 4) produced by a difference in electrical potential between the capillary needle 11 and the extractor plate or electrode 14 has radial symmetry. The electric field $E_1$ is the primary force field used to electrically stress the liquid at the tip of the capillary opening of needle 11 and can be adjusted by the high voltage supply $V_1$ or by adjusting screws in spacers 25 to change the relative distance between the tips of the needles 11 and the extractor electrode 14. The substrate 30 (see FIG. 4) to be coated is placed several centimeters away from the tips of capillary needles 11 with a metal ground plane 31 placed behind the substrate 30. The substrate 30 is also usually charged with the opposite polarity to that of the capillary needles.

Figure 4:
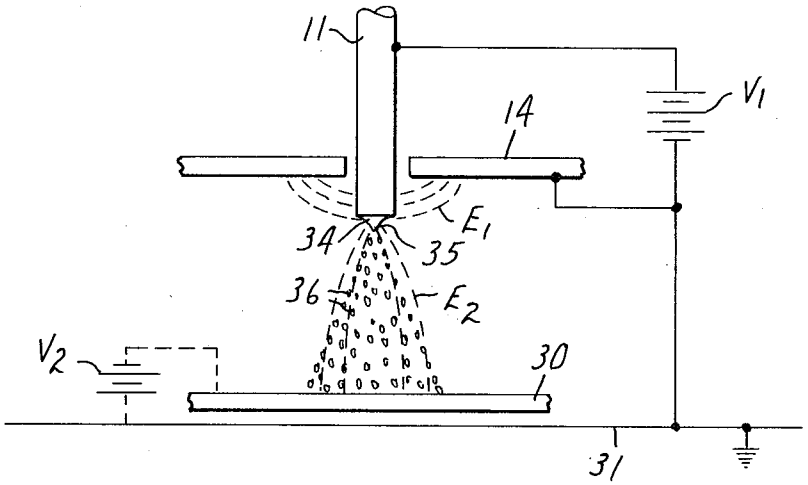
FIG. 4 is a diagrammatic view of the electrical circuit for the present invention and a single dispensing needle used to produce an ultra-fine mist of droplets.

A single needle 11 of the coating head 10 is shown in FIG. 4. Each needle 11 is used to produce an ultra-fine mist of droplets. The capillary needle 11 is supplied with the material to be coated from the manifold 15 at a low flow rate and is placed in proximity to the extractor plate 14 with radial symmetry to the hole 13 in the extractor plate 14. An electrical potential $V_1$ applied between the capillary needle 11 and the extractor plate 14 provides a radially symmetrical electric field between the two. The liquid is electrically stressed by this electric field first into a cone 34 at the very end of the capillary needle and then into a fine filament 35. This filament 35 is typically one or two orders of magnitude smaller than the capillary diameter. Rayleigh jet breakup of this fine liquid filament occurs and causes a fine mist 36 of highly charged ultra-fine droplets to be produced.

These droplets can be further reduced in size if evaporation of solvent from the droplet occurs. When this happens it is believed the charge on the droplet will at some point exceed the Rayleigh charge limit and the droplet will disrupt into several highly charged, but stable smaller droplets. Each of these droplets undergoes further evaporation until the Rayleigh charge limit is again reached and disruption again occurs. Through a succession of several disruptions, solute droplets as small as 500 angstroms in diameter can be produced.

The ultra-fine droplets can be controlled and directed by electric fields to strike the surface of substrate 30 positioned over the ground plane 31. A spreading of the drops occcurs on the surface of the substrate and the surface coating is produced. FIG. 4 also shows the electrical circuit for the electrospray process. The polarities shown in FIG. 4 from the illustrated battery are commonly used, however, these polarities can be reversed. As illustrated, the positive polarity is applied to the capillary needle 11. A negative polarity is attached to the extractor plate 14.

Voltage $V_1$ is produced between the needle 11 and extractor plate 14 by a high voltage supply and is adjusted to create and desired electric field, $E_1$, between the capillary tip and extractor plate. This electric field $E_1$ is dependent on the geometry of the capillary needle and extractor plate.

The mist 36 to be created is dependent upon the fluid and electrical properties of the solution in conjunction with electric field $E_1$. Fine control of $E_1$, and thus the mist, can be obtained by varying the capillary tip position with respect to the plane of the extractor plate 14 or by varying the voltage $V_1$. Although the capillary tip of needle 11 can be located within about 2 cm of either side of the plane of the extractor plate, the preferred position is with the needle extending through the extractor plate 14 from 0.5 to 1.5 cm. The voltage to obtain this field $E_1$ for the geometry herein described ranges from 3 KV dc to 10 KV dc and is typically between 4 KV dc and 8 KV dc. An alternating current may be imposed on the circuit between the needle and the extractor plate for purposes of producing a frequency modulated to stabilize the creation of monosized droplets.

The substrate to be coated is charged as described hereinafter and a voltage $V_2$ results, the magnitude of which is a function of the charge per unit area on the substrate 30, the substrate thickness and its dielectric constant. When the substrate 30 to be coated is conductive and at ground potential the voltage $V_2$ is zero. Discrete conductive substrates, such as a metal disc, placed on an insulated carrier web, can be charged and would have an impressed voltage $V_2$. An electric field $E_2$ generated between the capillary tip of the needle 11 and the substrate 30 is a function of $V_1$ and $V_2$ and the distance between the capillary tip and the substrate. To insure placement of all the mist droplets on the substrate it is necessary that the potential $V_2$ never obtains the same polarity as potential $V_1$. Although coatings are possible when these polarities are the same, coating thickness cannot be assured since some droplets are repelled from the substrate and therefore process control is lost. The distance between the capillary tip and the substrate is determined experimentally. If the distance is too small, the mist doesn't expand properly and if the distance is too great the field $E_2$ is weak and control is lost in directing the droplets to the substrate. The typical distance for the geometry herein described is between 5 cm and 15 cm. Plates positioned perpendicular to the extractor plate and extending in the direction of movement of the substrate help guide the droplets to the substrate.

In the electrospray process electric field $E_1$ is the primary field controlling the generation of the fine mist. Electric field $E_2$ is used to direct the droplets to the substrate where they lose their charge and spread to form the desired coating. Because the droplets tend to repel each other, thin paths through the coating of the first row of needles appear and the staggered position of the needles in the second row of needles in relationship to the path of the web will produce droplets which will coat the paths left by the first row of needles.

Figure 3:
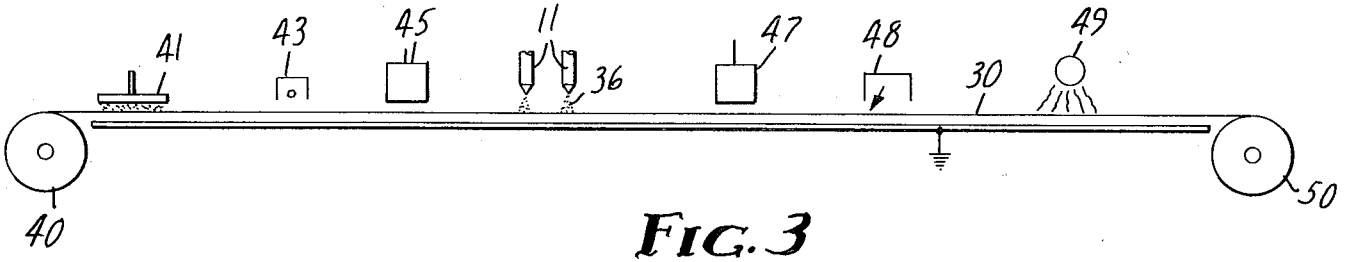
FIG. 3 is a diagrammatic view showing the basic steps in a continuous process utilizing a head constructed according to this invention.

Referring now to FIG. 3, where the coating process is shown schematically, a roll 40 of substrate 30 to be treated is optionally passed through a corona treater 41 where an electrical discharge precleans the substrate 30. The corona treater 41 may also excite or activate the molecules of the cleaned surface. This can raise the surface energy of the substrate and enhance the wetting and spreading of droplets deposited on the surface. Other methods of cleaning or using a fresh substrate would, of course, be within the spirit of the precleaning step.

If the substrate is nonconductive, a charge, opposite in polarity from the droplet spray, is then placed on the substrate, as for example, by a corona wire 43. Of course, other methods, including ion beams, ionized forced air, etc., would also be used in the charging step. The magnitude of the charge placed on the surface is monitored using an electrostatic voltmeter 45 or other suitable means. If the substrate is conductive, this charging step is produced by connecting the substrate to ground.

The liquid to be electrosprayed is provided at a predetermined volume flow rate through a group of capillary needles 11 at the electrospray head 10 such as shown in FIG. 1. The electric field $E_2$ forces the fine droplets of electrospray mist 36 down to the surface of the substrate 30 where charge neutralization occurs as the droplets contact the substrate and spread. If the substrate is nonconductive the charge neutralization reduces the net charge on the substrate and this reduction is measured with an electrostaic voltmeter 47. For accurate coatings, the voltage measured at 46 must be of the same polarity as the voltage measured at 45. This assures a reasonably strong electric field terminates on the substrate, thus affording a high degree of process control.

Under most conditions it is advantageous to neutralize the charge on the substrate after coating. This neutralization step can be accomplished by methods well known in the coating art. A typical neutralizing head 48 may be a Model 641-ESE 3M Electrical Static Eliminator obtainable from Minnesota Mining and Manufacturing Company of St. Paul, Minn. The coating material is then cured by a method suitable for the coating material and such curing device is depicted at 49 and the coated substrate is rewound in a roll 50. A typical curing device may be a UV lamp, on electron beam or a thermal heater.

Figure 5:
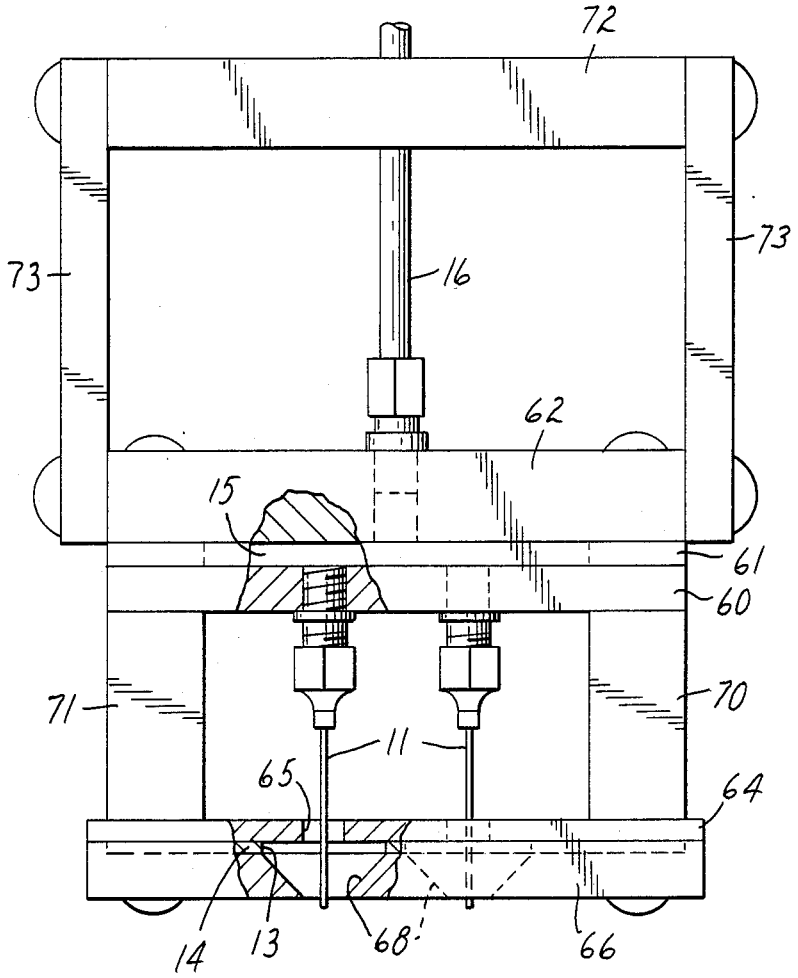
FIG. 5 is a vertical partial sectional view of a second embodiment of a coating head according to the present invention.

A second embodiment of the coating head is illustrated in FIG. 5 and comprises two longitudinal rows of capillary needles 11 secured to a stainless steel plate 60 to communicate with a reservoir 15. The reservoir is formed by a gasket 61 positioned between the plate 60 and a second plate 62 having an opening communicating with a supply line 16 leading from a pump supplying the coating material.

The needles 11 extend through openings 13 in an extractor plate 14. A sheet of plastic material 64 is positioned above the upper or inner planar surface of the extractor plate 14 with an opening 65 to receive the needle 11. A second sheet 66 is positioned adjacent the opposite planar surface of the plate 14 and covers the planar edges. The sheet 66 has a countersunk hole 68 formed therein and aligned with each hole 13 to restrict the movement of any droplets toward the extractor plate 14 under the electrostatic forces produced between the extractor plate 14 and the needles 11. The extractor plate 14 and sheets 64 and 66 are supported from the conductive plate 60 by insulative spacers 70 and 71. A plate 72 provides support for the head and is joined to the coating head by insulative braces 73.

The solution to be electrosprayed must have certain physical properties to optimize the process. The electrical conductivity should be between $10^{-7}$ and $10^{-3}$ siemens per meter. If the electrical conductivity is much greater than $10^{-3}$ siemens per meter, the liquid flow rate in the electrospray becomes too low to be of practical value. If the electrical conductivity is much less than $10^{-7}$ seimens per meter, liquid flow rate becomes so high that thick film coatings result.

The surface tension of the liquid to be electrosprayed (if in air at atmospheric pressure) should be below about 65 millinewtons per meter and preferably below 50 millinewtons per meter. If the surface tension is too high a corona will occur around the air at the capillary tip. This will cause a loss of electrospray control and can cause an electrical spark. The use of a gas different from air will change the allowed maximum surface tension according to the breakdown strength of the gas. Likewise, a pressure change from atmospheric pressure and the use of an inert gas to prevent a reaction of the droplets on the way to the substrate is possible. This can be accomplished by placing the electrospray generator in a chamber and the curing station could also be disposed in this chamber. A reactive gas may be used to cause a desired reaction with the liquid filament or droplets.

The viscosity of the liquid must be below a few thousand centipoise, and preferably below a few hundred centipoise. If the viscosity is too high, the filament 35 will not break up into uniform droplets.

The electrospray process of the present invention has many advantages over the prior art. Because the coatings can be put on using little or no solvent, there is no need for large drying ovens and their expense, and there are less pollution and environmental problems. Indeed in the present invention, the droplets are so small that most if not all of the solvent present evaporates before the droplets strike the substrate. This small use of solvent means there is rapid drying of the coating and thus multiple coatings in a single process line have been obtained. Porous substrates can be advantageously coated on one side only because there is little or no solvent available to penetrate to the opposite side.

This is a noncontacting coating process with good control of the uniform coating thickness and can be used on any conductive or nonconductive substrate. There are no problems with temperature sensitive materials as the process is carried out at room temperature. Of course if higher or lower temperatures are required, the process conditions can be changed to achieve the desired coatings. This process can coat low viscosity liquids, so monomers or oligomers can be coated and then polymerized in place on the substrate. The process can also be used to coat through a mask leaving a pattern of coated material on the substrate. Likewise, the substrate can be charged in a pattern and the electrospray mist will preferentially coat the charged areas.

The following examples illustrate the use of the elecrospray process to coat various materials at thickness ranging from a few tens of angstroms to a few thousand angstroms (Å).

EXAMPLE 1

This example describes the use of the electrospray coating process to deposit a very low coating thickness of primer. The solution to be coated was prepared by mixing 80 ml of "Cross-linker CX-100" from Polyvinyl Chemical Industries, Wilmington, Mass. 01887, with 20 ml of water. This material was introduced into a coating head which contained only 21 capillary needles using a Sage Model 355 syringe pump available from Sage Instruments of Cambridge, Mass. A high voltage ($V_1$) of 3.4 to 3.8 KV dc was applied between the capillary needles 11 and the extractor plate 14.

A 25.4 cm wide 0.2 mm poly(ethyleneterephthalate) (PET) film was introduced into the transport mechanism. The electrospray extractor plate, held at ground potential, was spaced approximately 6 cm from the film surface. The capillary tip to extractor plate distance was 1.2 cm.

The film was charged under the Corona charger to a potential of approximately −4.6 KV. The web speed was held fixed at 23 m/min and the volume flow rate per orifice and high voltage potential on the spray head were varied to give the final primer coatings shown as follows:

| Head potential ($V_1$) +(KV) | Per orifice volume flow rate (ul/hr) | Coating thickness Å |
|---|---|---|
| 3.8 | 104 | 50 |
| 3.8 | 89 | 43 |
| 3.4 | 85 | 41 |
| 3.4 | 73 | 35 |

Coating thicknesses were calculated from first principles. These thicknesses are too small to measure but standard tape peel tests in both the cross web and down web directions after thermal curing showed an increased peel force, proving the primer material was present.

EXAMPLE 2

The object of this example is to show the production of a release liner for adhesive products using a low adhesion backsize (LAB) coating. A first mixture of perfluoropolyether-diacrylate (PPE-DA) was prepared as described in U.S. Pat. No. 3,810,874. The coating solution was prepared by mixing 7.5 ml of PPE-DA, 70 ml of Freon 113 from E. I. Du Pont de Nemours of Wilmington, Del., 21 ml of isopropyl alcohol and 1.5 ml of distilled water. This material was introduced into the 27 needle coating head using a Sage model 355 syringe pump to provide a constant flow rate of material. A high voltage $V_1$ of −5.9 KV dc was applied between the capillary needles and the extractor plate.

A 30.5 cm wide 0.07 mm PET corona pre-cleaned film was introduced into the transport mechanism. The electrospray extractor plate, held at ground potential, was spaced approximately 6 cm from the film surface. The capillary tip to extractor plate distance was 0.8 cm.

The film passed under the Corona charger and the surface was charged to a potential of approximately +5 KV. The web transport speed was fixed at 12.2 m/min and the volume flow rate per orifice was varied giving the final LAB uncured coating thicknesses shown:

| per orifice volume flow rate (ul/hr) | Coating thickness Å |
|---|---|
| 2200 | 200 |
| 4400 | 400 |
| 6600 | 600 |
| 8800 | 800 |
| 11000 | 1000 |

Coating thicknesses were calculated from first principles and then verified to be within 10% by a transesterification analysis similar to the description in Handbook of Analytical Derivatization Reactions, John Wiley and Sons, (1979), page 166.

EXAMPLE 3

This example shows the use of the electrospray process for coating lubricants on films. A first mixture consisting of a 3:1 weight ratio of hexadecyl stearate and oleic acid was prepared. The coating solution was prepared by mixing 65 ml of the above solution with 34 ml of acetone and 1 ml of water. This material was introduced into the 27 needle coating head using a Sage Model 355 syringe pump. A high voltage of −9.5 KV dc was applied between the capillary needles and the grounded extractor plate.

Strips of material to be later used for magnetic floppy discs were taped on a 30 cm wide, 0.07 mm PET transport web. The extractor plate was spaced approximately 10 cm from the film surface. The capillary tip to extractor plate distance was 1.2 cm.

The surface of the strips were charged under the Corona charger to a potential of approximately +0.9 KV. The web transport speed and the volume flow rate per orifice were varied to give the final lubricant coating thicknesses shown as follows:

| Web speed (m/min) | per orifice volume flow rate (ul/hr) | Coating thickness Å |
|---|---|---|
| 16.7 | 1747 | 1000 |
| 12.2 | 2541 | 2000 |
| 12.2 | 3811 | 3000 |
| 10.1 | 3811 | 3650 |

Coating thicknesses were calculated from first principles and verified to be within 15% by standard solvent extraction techniques.

EXAMPLE 4

This example describes the use of the electrospray coating process to deposit a very low coating thickness of primer on a film in an industrial setting. The solution to be coated was prepared as a mixture of 70 volume % "Cross-linker CX-100" from Polyvinyl Chemical Industries, and 30 volume % isopropyl alcohol. This solution was introduced into a 62 capillary needle spray head using a Micropump® from Micropump Corporation, Concord, Calif. A voltage of +9 KV dc was applied between the capillary needles and the extractor plate. The extractor plate was covered with a 0.95 cm thick layer of Lexan® plastic as available from General Electric Company of Schenectady, N.Y., as shown in FIG. 5, instead of the aforementioned 0.2 mm layer of Scotch Brand® 5481 film tape.

A 96.5 cm wide 0.11 mm PET film was introduced into the transport mechanism. The electrospray extractor plate, held at ground potential, was spaced approximately 6.8 cm from the film surface. The capillary tip to extractor plate distance was 1.1 cm.

The film passed under the corona charger and the surface was charged to a potential of approximately −10 Kv.

The film speed was held constant at 98.5 m/min. and the solution flow rate was held at 1300 ul/orifice/hr. The calculated coating thickness of primer was 100 Å.

Having thus described the present invention it will be understood that modifications may be made in the structure without departing from the spirit or the scope of the invention as defined in the appended claims.

We claim:

1. An electrospray coating head for coating a very thin uniform coating on a substrate comprising a conductive support plate supporting a plurality of conductive capillary needles arranged in at least two rows with the tips of said needles being in the same plane, said needles being covered with an electrically insulative coating, a conductive extractor plate having a plurality of circular holes with one said needle positioned coaxially with each hole, said extractor plate being supported to space an inner surface of said extractor plate a predetermined distance from said support plate and the opposite surface from a said substrate, said extractor plate having the opposed surfaces covered with an electrically insulative coating, manifold means communicating with said capillary needles for supplying liquid to said capillary needles, and electrical means for developing an electrical potential between each said capillary needle and said extractor plate sufficient to generate a mist of highly charged ultra-fine droplets.

2. An electrospray coating head according to claim 1 wherein said array of capillary needles includes more than twenty needles disposed in two parallel rows with the needles staggered in transverse spacial relationship in the rows.

3. An electrospray coating head according to claim 1, wherein the insulating layer disposed on said opposite surface of said extractor plate has a smaller opening on the exposed surface of the insulating layer than said circular holes through said extractor plate and said smaller opening is aligned with said needles to restrict buildup of droplets on said needles and on said extractor plate in said circular holes.

4. An electrospray coating head according to claim 1 wherein said insulating layer on said extractor plate is an electrically insulative pressure sensitive adhesive tape.

5. An electrospray coating head according to claim 3 wherein said insulating layer on said opposite surface of said extractor plate is a sheet of electrically insulative plastic sheet material.

6. An electrospray coating head according to claim 1 wherein said insulative coating on said needles extends along said needles to within 0.8 mm of said tips.

7. A process for coating a substrate having sufficient surface energy to allow a wetting of its surface by droplets of a coating material to form a very thin uniform coating thereon, said process comprising the steps of pumping the coating material to at least two rows of capillary needles having the tips arranged in the same plane and having an electrically insulative coating, creating an electrostatic force between each needle and a surrounding extractor plate to generate a spray of droplets, advancing a said substrate past said rows of needles and spaced from said plane of the tips by between 5 and 15 cm, said substrate having sufficient surface energy to be wet by said coating material, creating a second electrical potential between said needles and said substrate surface to attract charged droplets of material to said surface, and discharging said surface of said substrate.

8. A process according to claim 7 including the step of pumping said material to said needles at volumes of between 70 and 11000 ul/hr per needle.

9. A process for coating a substrate having sufficient surface energy to allow a wetting of said surface by droplets of liquid to form a coating of material to a thickness of less than 5000 Angstroms comprising the steps of charging said substrate to develop an electrostatic field, advancing the substrate along a path transversely of at least two rows of capillary needles having tips spaced from a said substrate sufficiently to allow a mist of droplets to be formed, pumping the coating material to the needles, developing an electrostatic force between said needles and an extractor plate for developing a spray of droplets from said material pumped through each needle and directing the spray toward said substrate, and removing the charge on said coated substrate.

10. A process for coating a substrate according to claim 9 wherein said coating material is one of an oligomer or monomer.

11. A process for coating a substrate according to claim 9 wherein said process includes the step of curing the coating.

12. A process for coating coating according to claim 9 comprising the step of cleaning said substrate prior to charging said substrate.

13. A process according to claim 9 wherein said charging step comprises placing a charge on one surface of a substrate where said coating is desired.

14. A process according to claim 9 wherein said charging step comprises connecting the substrate to a ground plane.

15. A process according to claim 9 wherein said process includes the step of placing said substrate in an area with air at atmospheric pressure.

16. A process according to claim 9 wherein said process includes the step of placing said substrate in the presence of a gas other than air.

17. An electrospray coating apparatus for applying a very thin coating having a thickness of less than 5000 Angstroms to a substrate comprising:

means defining a path for a web of said substrate, means for applying a charge to a surface of said substrate, a coating head for imparting a fine mist of charged droplets to said charged substrate, said head comprising a conductive plate supporting a plurality of capillary needles arranged in at least two staggered rows with the tips of said needles being in the same plane and spaced above said means defining the path for said substrate, said needles being covered with an electrically insulative coating, a conductive extractor plate having a plurality of circular holes with one of said needles positioned coaxially with each hole, said extractor plate being supported in spaced relation to said conductive plate, said extractor plate being covered with an electrically insulative coating to restrict the collection of said droplets on said extractor plate, manifold means communicating with said capillary needles for supplying fluid to said capillary needles, and electrical means for developing an electrical potential between each said capillary needle and said extractor plate, and means for curing said coating material on said substrate.

* * * * *